US008390520B2

(12) United States Patent
Lee et al.

(10) Patent No.: US 8,390,520 B2
(45) Date of Patent: Mar. 5, 2013

(54) DUAL-PATCH ANTENNA AND ARRAY

(75) Inventors: Jar J. Lee, Irvine, CA (US); Fangchou Yang, Los Angeles, CA (US); Stan W. Livingston, Fullerton, CA (US); Jeffrey B. Weber, Fullerton, CA (US)

(73) Assignee: Raytheon Company, Waltham, MA (US)

( * ) Notice: Subject to any disclaimer, the term of this patent is extended or adjusted under 35 U.S.C. 154(b) by 478 days.

(21) Appl. No.: 12/722,397

(22) Filed: Mar. 11, 2010

(65) Prior Publication Data

US 2011/0221644 A1 Sep. 15, 2011

(51) Int. Cl.
*H01Q 1/38* (2006.01)

(52) U.S. Cl. ..... 343/700 MS; 343/702; 343/767; 343/770

(58) Field of Classification Search ..... 343/700 MS, 343/702, 767, 770, 789, 803, 846, 848, 854
See application file for complete search history.

(56) References Cited

U.S. PATENT DOCUMENTS

| | | | | |
|---|---|---|---|---|
| 3,813,674 | A * | 5/1974 | Sidford | 343/730 |
| 5,579,021 | A | 11/1996 | Lee | |
| 5,900,843 | A | 5/1999 | Lee | |
| 6,297,776 | B1 * | 10/2001 | Pankinaho | 343/700 MS |
| 6,473,040 | B1 | 10/2002 | Nakamura | |
| 7,057,569 | B2 | 6/2006 | Isoifovich et al. | |
| 7,315,288 | B2 | 1/2008 | Livingston et al. | |
| 7,589,692 | B2 * | 9/2009 | Kim et al. | 343/846 |
| 2006/0170595 | A1 | 8/2006 | Gustaf | |
| 2009/0295645 | A1 * | 12/2009 | Campero et al. | 343/700 MS |

FOREIGN PATENT DOCUMENTS

| | | | |
|---|---|---|---|
| EP | 0 942 488 | A2 | 9/1999 |
| GB | 2 067 842 | A | 7/1981 |

* cited by examiner

*Primary Examiner* — Vibol Tan
(74) *Attorney, Agent, or Firm* — Christie, Parker & Hale, LLP

(57) ABSTRACT

A dual-patch antenna includes a ground plane, a first patch plate parallel to and separated from the ground plane by a separation distance, and a second patch plate separated from the ground plane by the separation distance. The first and second patch plates are coplanar and separated by a radiating slot. An excitation probe isolatedly passes through the ground plane and connects to the first patch plate. A first wall connects an edge of the first patch plate to the ground plane. The first wall is located approximately ¼ wavelength of a mid-band operating frequency from the radiating slot. A second wall connects an edge of the second patch plate to the ground plane. The second wall is located approximately ¼ wavelength of the mid-band operating frequency from the radiating slot. The dual-patch antennas may be organized in an array.

10 Claims, 5 Drawing Sheets

DUAL-PATCH ANTENNA AND ARRAY

BACKGROUND

The present invention relates to the field of antennas and, more particularly, to low profile antenna arrays for airborne applications.

Antenna systems are an important part of electronic warfare (EW) and radar applications for jamming and electronic attacks. Such antenna systems need low profiles when installed on airborne platforms. For low profile requirements, conventional antenna designs have used patch radiating elements, which are thin and low profile.

FIGS. 1A, 1B, and 1C depict patch antenna configurations. FIG. 1A schematically depicts a cross section of a typical patch antenna 10. A patch element 12 is located above a ground plane 14. The patch element 12 is fed by a probe 16 that is isolated from the ground plane 14. Antenna radiation occurs at ends 18*a*, 18*b*. FIG. 1B depicts an alternative patch antenna 20, which is similar to that depicted in FIG. 1A, but with a patch element 12' having an end 18*c* connected to the ground plane 14. The ground plane connection occurs at a distance $\lambda/4$ from the probe 16, where $\lambda$ is a wavelength of radiation with which the antenna is used. This configuration provides for radiation only from end 18*b*. FIG. 1C depicts yet another patch antenna arrangement wherein multiple patch antennas, for example, those of FIG. 1B, are in an array 30 with each of the radiating ends facing in a same direction 32. This array arrangement takes advantage of the array factor gain (G (db)=10 log N, where N is the number of array elements) for improved radiation strength.

In military applications such as detecting targets under trees, road side bombs, land mines, and border tunnels, low band (VHF, UHF) antennas are typically used. However, radiating elements at these frequencies are typically very long and pose a problem for airborne platforms. While patch antenna elements may be thin, they have a very limited 5% bandwidth and are not suitable for systems that require 20% bandwidth. Furthermore, some EW missions require high power (45 kW) transmit antennas operating at VHF (150 MHz) for jamming and attacks. Such capabilities are not readily available, so there has been a critical need to develop a low profile VHF antenna with sufficient bandwidth for high power applications.

Patch antenna configurations generally have very limited bandwidth (for example, 5%) and, as a result, are not suitable for EW and radar applications that require a large bandwidth (for example, 20%) and high power for jamming and electronic attacks. As such, there is a need for a low-profile antenna that provides 20% bandwidth at VHF (150 MHz) and supports high power (3 kW per element) applications.

SUMMARY OF THE INVENTION

Embodiments of the present invention provide an ultra low profile antenna operating in VHF (150 MHz) suitable for airborne platforms. The embodiments support 20% bandwidth at VHF with an antenna thickness of approximately 3".

An exemplary embodiment of the present invention provides a dual-patch antenna, including a ground plane, a first patch plate parallel to and separated from the ground plane by a separation distance, a second patch plate separated from the ground plane by the separation distance, coplanar with the first patch plate, and separated from the first patch plate by a radiating slot, an excitation probe isolatedly passing through the ground plane and connecting to the first patch plate, a first wall connecting an edge of the first patch plate to the ground plane, the first wall located approximately ¼ wavelength of a mid-band operating frequency from the radiating slot; and a second wall connecting an edge of the second patch plate to the ground plane; the second wall located approximately ¼ wavelength of the mid-band operating frequency from the radiating slot.

Another exemplary embodiment of the present invention provides a dual-patch antenna array, including a plurality of dual-patch antennas, each dual-patch antenna including: a ground plane; a first patch plate parallel to and separated from the ground plane by a separation distance; a second patch plate separated from the ground plane by the separation distance, coplanar with the first patch plate, and separated from the first patch plate by a radiating slot; an excitation probe isolatedly passing through the ground plane and connecting to the first patch plate; a first wall connecting an edge of the first patch plate to the ground plane, the first wall located approximately ¼ wavelength of a mid-band operating frequency from the radiating slot; and a second wall connecting an edge of the second patch plate to the ground plane, the second wall located approximately ¼ wavelength of the mid-band operating frequency from the radiating slot, wherein the radiating slots are colinear.

Another exemplary embodiment of the present invention provides a dual-patch antenna array, including a plurality of dual-patch antenna subarrays, each dual-patch antenna subarray including a plurality of dual-patch antennas, each dual-patch antenna including: a ground plane; a first patch plate parallel to and separated from the ground plane by a separation distance; a second patch plate separated from the ground plane by the separation distance, coplanar with the first patch plate, and separated from the first patch plate by a radiating slot; an excitation probe isolatedly passing through the ground plane and connecting to the first patch plate; a first wall connecting an edge of the first patch plate to the ground plane, the first wall located approximately ¼ wavelength of a mid-band operating frequency from the radiating slot; and a second wall connecting an edge of the second patch plate to the ground plane, the second wall located approximately ¼ wavelength of the mid-band operating frequency from the radiating slot, wherein the radiating slots within each dual-patch antenna subarray are colinear within the dual-patch antenna array and are substantially parallel to the radiating slots of the other dual-patch antenna subarrays.

BRIEF DESCRIPTION OF THE DRAWINGS

These and other features and aspects according to exemplary embodiments of the present invention will become better understood in reference to the following description, appended claims, and accompanying drawings where:

DETAILED DESCRIPTION

Figure 1A:
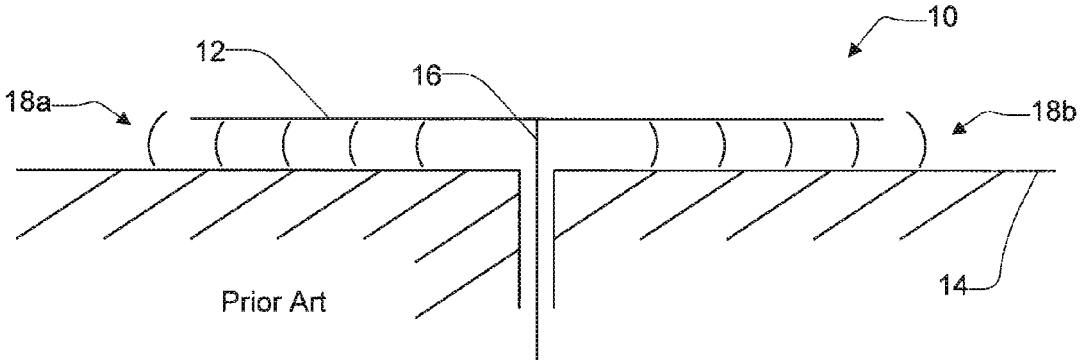
FIGS. 1A, 1B, and 1C show conventional patch antenna configurations.
Figure 1B:
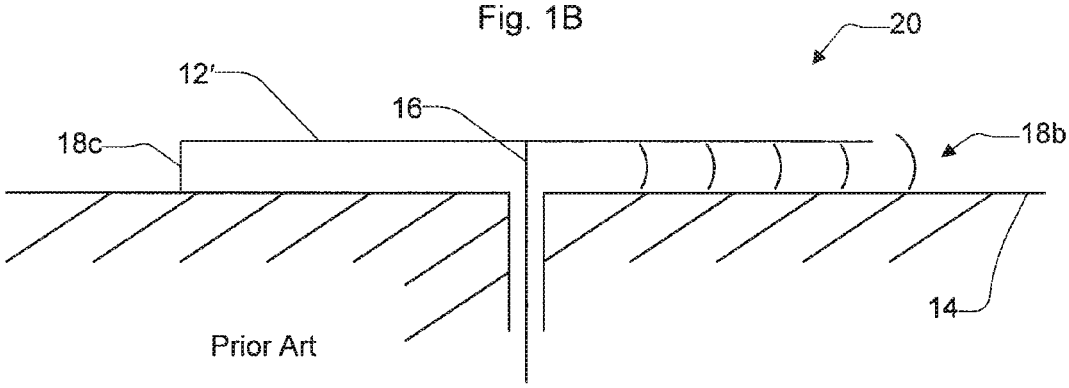
Figure 1C:
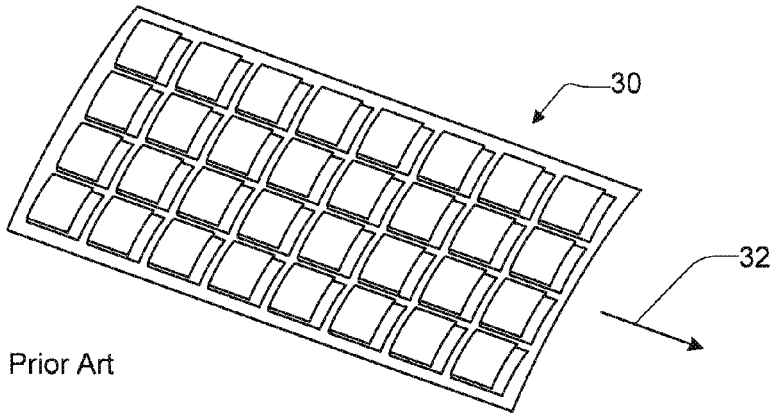
Figure 2A:
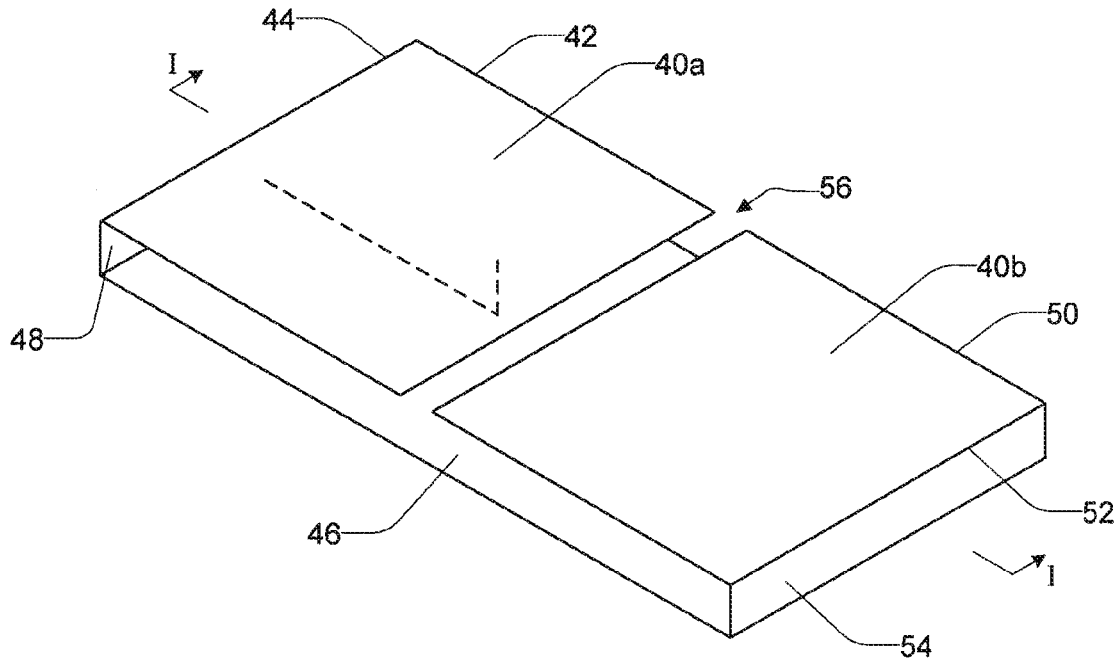
FIGS. 2A, 2B, and 2C show an exemplary embodiment of a double patch antenna in accordance with the present invention.
Figure 2B:
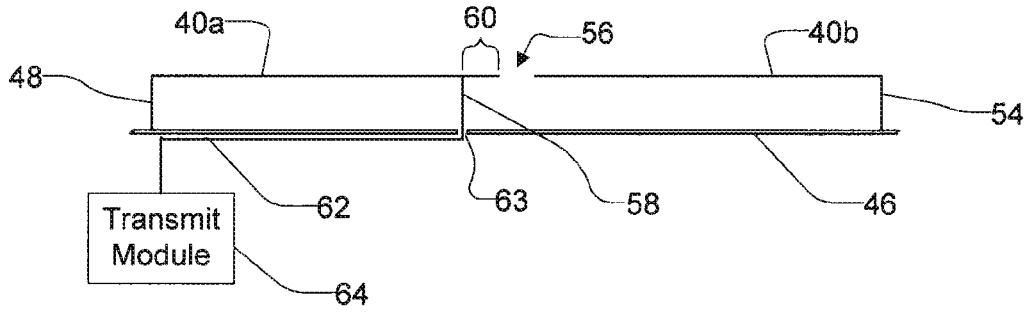
Figure 2C:
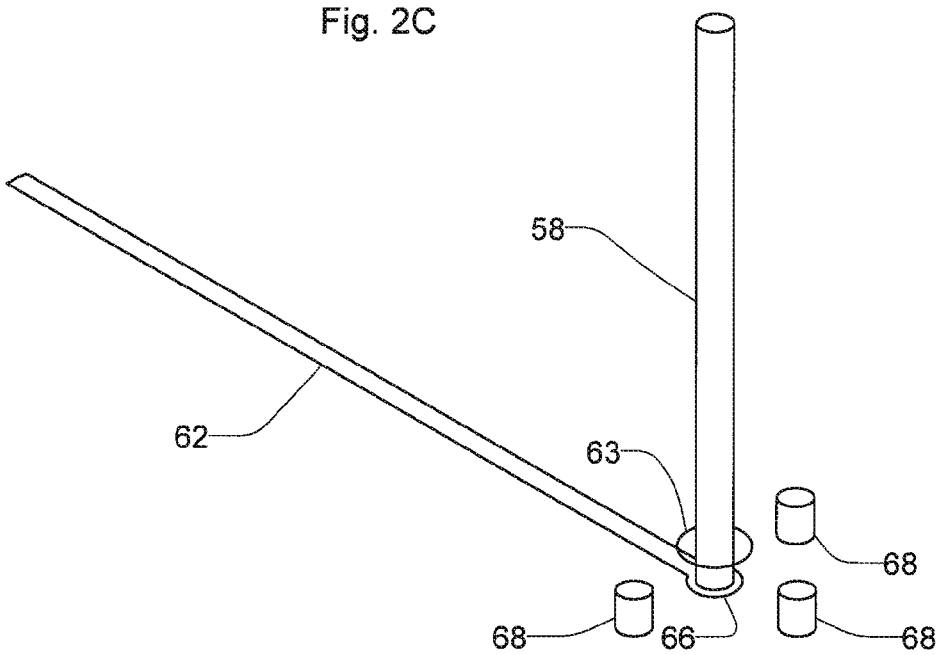

Referring now to FIGS. 2A, 2B, and 2C, an exemplary embodiment of the present invention is described. FIG. 2A is an isometric diagram of an antenna 40. FIG. 2B is a cross-sectional diagram of the antenna 40 along plane I-I of FIG. 2A. FIG. 2C is diagram of feedline details of the antenna 40.

The antenna 40 includes a first patch element 40*a* and a second patch element 40*b*. Each of the patch elements 40*a*, 40*b* is a rectangular conductor. The first patch element 40*a* and the second patch element 40*b* are coplanar. The first patch element 40*a* and the second patch element 40*b* are aligned with an edge of each element parallel and separated by a slot 56.

The antenna 40 also includes a ground plane 46. The first patch element 40*a* and the second patch element 40*b* are located parallel to the ground plane 46. The patch elements 40*a*, 40*b* are separated from the ground plane 46 by a distance that is much less than the wavelength of the signals to be radiated.

The antenna 40 also includes a first wall 48 and a second wall 54. The first wall 48 connects the first patch element 40*a* to the ground plane 46. The first wall 48 is perpendicular to the first patch element 40*a* and to the ground plane 46. The first wall 48 is parallel to the slot 56 and connected to the first patch element 40*a* at an edge opposite from the slot 56.

The second wall 54 connects the second patch element 40*b* to the ground plane 46. The second wall 54 is perpendicular to the second patch element 40*b* and to the ground plane 46. The second wall 54 is parallel to the slot 56 and connected to the second patch element 40*b* at an edge opposite from the slot 56.

The antenna 40 also includes an excitation probe 58. The excitation probe 58 is connected to the first patch element 40*a* at a location near the midpoint of the slot 56. The excitation probe 58 supplies radio frequency current to the first patch element 40*a*. The second patch element 40*b* provides a second branch for surface current allowing for a double-hump resonance that widens the operating bandwidth of the antenna 40. Driving only the first patch element 40*a* allows direct feed from a coaxial input and does not require use of a balun. Absence of a balun is particularly valuable in high-power applications.

The antenna 40 is driven by a transmit module 64 coupled to the excitation probe 58 via a quarter-wave transformer 62. The antenna has an impedance of approximately 100Ω, whereas the transmit module 64 has a 50Ω output impedance. In this instance, a 70Ω transformer will provide impedance matching. The quarter-wave transformer 62 may be a printed circuit microstrip on a dielectric located on the surface of the ground plane 46 that is opposite the patch elements 40*a*, 40*b*.

The patch elements 40*a*, 40*b* are termed "quarter-wavelength" or "λ/4" elements. Those skilled in the art will realize that quarter wavelength refers to the general size of the elements and not to any exact dimension. Furthermore, when the antenna is operated over a range of frequencies there is also a range of wavelengths. The specific dimensions of an embodiment of the present invention may be adapted to an application by adjusting the dimensions using, for example, numerical simulation.

In an exemplary embodiment intended for use over a 20% bandwidth of frequencies near 150 MHz, the first patch element 40*a* has an 18" side 42 and a 22.5" side 44. The second patch element 40*b* has a 14.1" side 50 and a 22.5" side 52. The separation between the patch elements 40*a*, 40*b* and the ground plane 46 is 3". The slot 56 separating the first patch element 40*a* from the second patch element 40*b* is 4.16".

In the same exemplary embodiment, the excitation probe 58 has a 0.100" diameter and is connected to the first patch element 40*a* with a 4.34" separation 60 from the slot 56. The excitation probe 58 passes through a 0.300" diameter hole 63 in the ground plane 46 and is isolated from the ground plane 46. The quarter-wave transformer 62 is 0.040" inch wide and 12.5" long. The quarter-wave transformer 62 connects to the excitation probe 58 at a 0.200" diameter pad 66. The 0.200" diameter pad 66 aids in impedance matching. Three 0.100" diameter by 0.225" long vias 68 are spaced around the transformer-to-excitation probe connection to further aid in impedance matching. This arrangement achieves a return loss lower than −10 dB over the desired 20% bandwidth.

Figure 3:
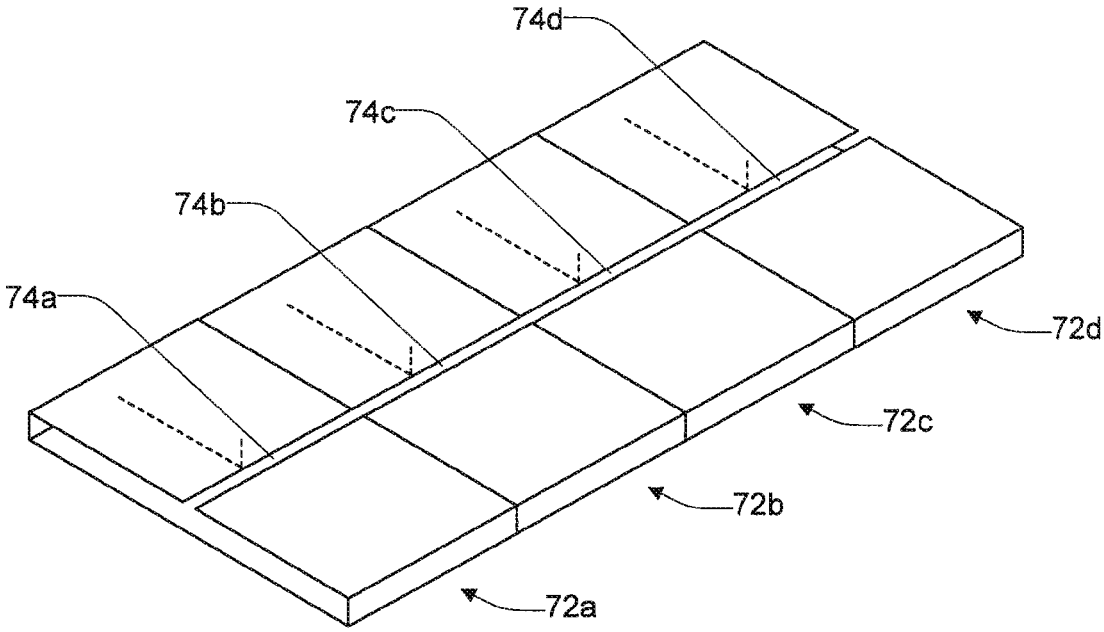
FIG. 3 shows an exemplary embodiment of a four-element, continuous-slot antenna array in accordance with the present invention.

Referring now to FIG. 3, another exemplary embodiment is depicted wherein a dual patch antenna array 70 includes four dual-patch antennas 72*a*, 72*b*, 72*c*, 72*d*. Each of the dual-patch antennas 72*a*, 72*b*, 72*c*, 72*d* is as described above and as illustrated in FIGS. 2A, 2B, and 2C. The radiating slots 74*a*, 74*b*, 74*c*, 74*d* of antennas 72*a*, 72*b*, 72*c*, 72*d* are colinear. Each of the dual-patch antennas 72*a*, 72*b*, 72*c*, 72*d* abuts its neighboring antenna. The first patch elements (40*a* of FIG. 2A) of the four dual patch antennas may be formed of a continuous conductor. The other antenna surfaces may also be continuous conductors.

Figure 4A:
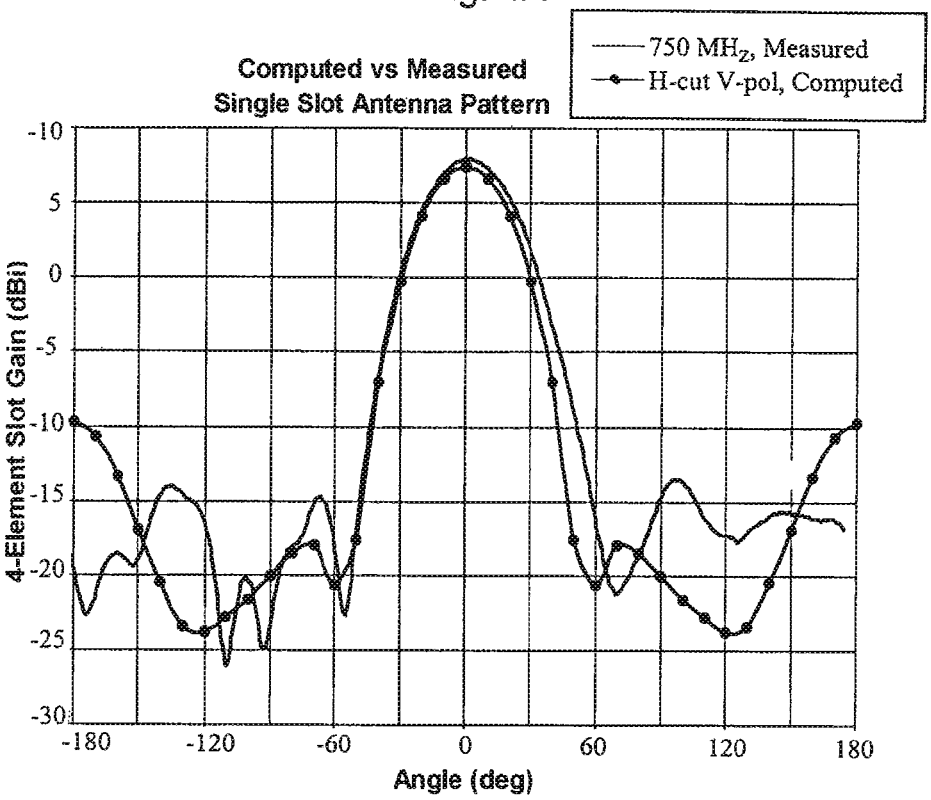
FIGS. 4A and 4B show comparisons between computed and measured gain vs. angle pattern for a ⅕ scale model of the exemplary embodiment shown in FIG. 3.
Figure 4B:
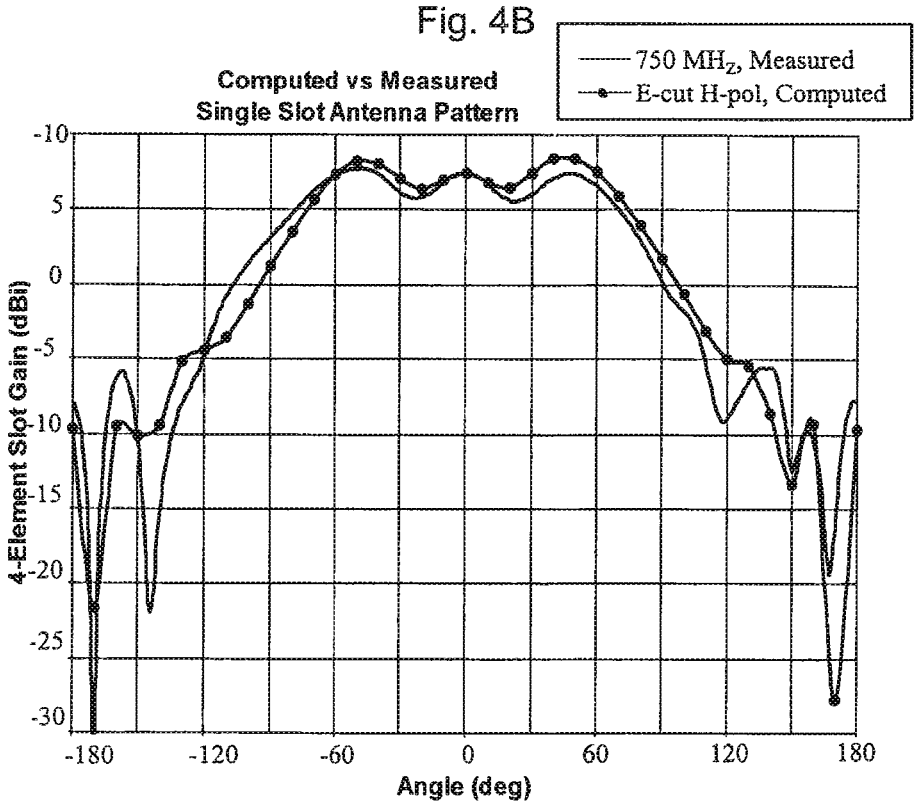

FIGS. 4A and 4B compare computed and measured gain patterns for a ⅕ scale model operating at 690-840 MHz of the 4-element continuous slot radiator of FIG. 3 for E-plane (H-polarization) and H-plane (V-polarization). Ripples in the E-plane patterns were determined to be caused by (vertical) edge diffractions of the finite ground plane. Those skilled in the art can appreciate that the measured data agrees with computed predictions and would be applicable to a full scale representation of the array configuration operating at 138-168 MHz.

Figure 5:
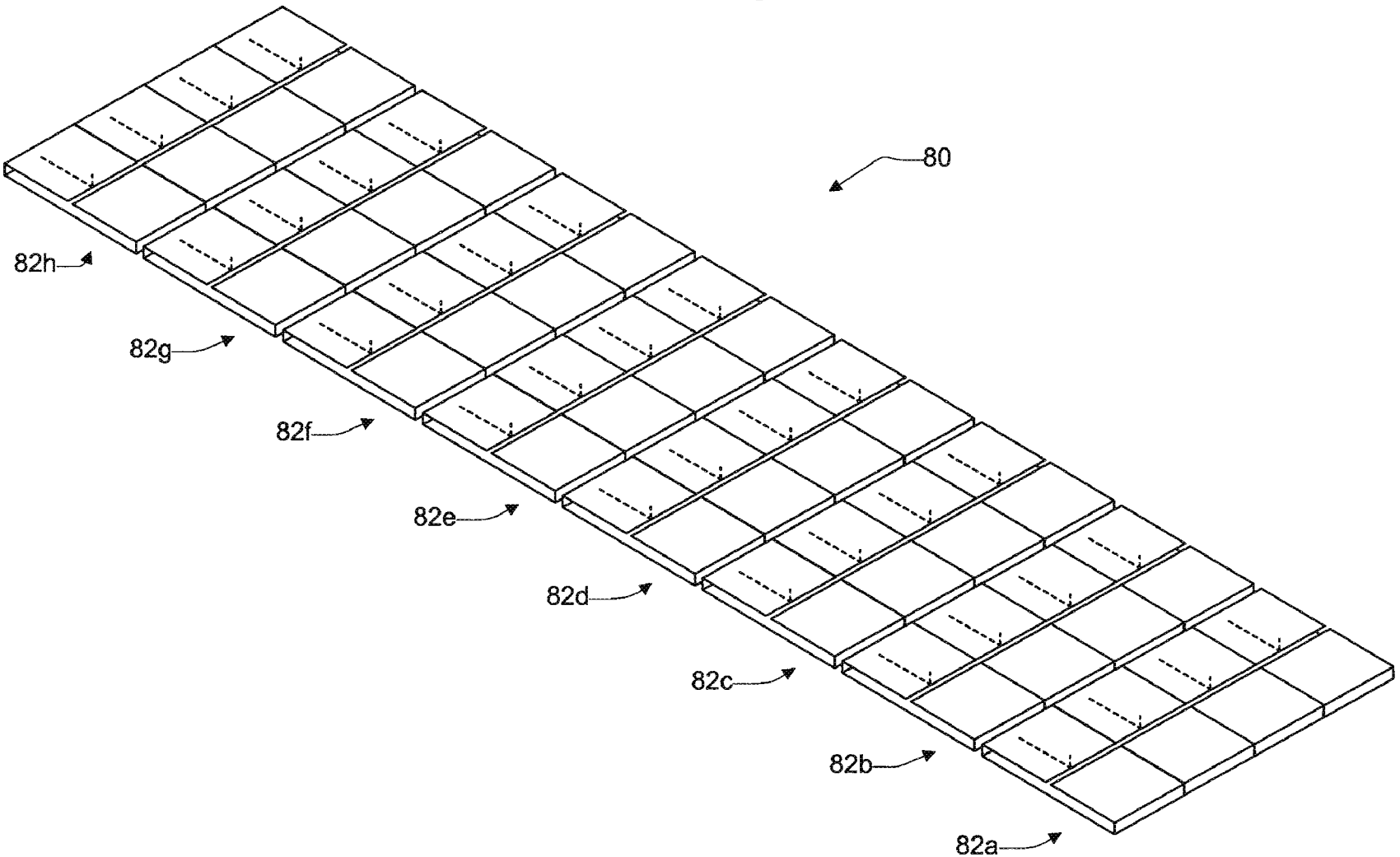
FIG. 5 shows another exemplary embodiment of an antenna array in accordance with the present invention.

Referring now to FIG. 5, another exemplary embodiment is depicted that includes a 4-by-8 array 80 of dual-patch antennas. Each of the dual-patch antennas is as described above regarding FIGS. 2A, 2B, and 2C. The dual-patch antenna array 80 includes eight adjacent dual-patch antenna subarrays 82*a-h*, where each dual-patch antenna subarray is as described above regarding FIG. 3. The radiating slot of each dual-patch antenna subarray is substantially parallel to the radiating slots of the other dual-patch antenna subarrays. The dual-patch antennas of adjacent subarrays are separated by a small distance. The antenna array 80 has the following features:

| | |
|---|---|
| Frequency | 138-168 MHz (20% bandwidth) |
| AZ Scan | +/−45 deg |
| Polarization | H-pol |
| Total TX Power | 225 kW peak, 20% duty, 45 kW average |
| No. Elements | 32 |
| Total thickness | 3" (5% wavelength at 150 MHz) |

The embodiments of the present invention take into account the mutual coupling of the elements and the edge diffraction effects of a finite array such that each radiating element is well matched in impedance with minimum reflections for power efficiency and protection of the high power amplifier (3 kW CW). Also, the finite array is well behaved over the scan volume to ensure stable performance. Moreover, the feed elements, connectors, and impedance transformers can withstand 15 kW peak power at each port without arcing. Reduced RF loss reduces cooling requirements for the system.

Although the present invention has been described in certain specific embodiments, many additional modifications and variations would be apparent to those skilled in the art. It is therefore to be understood that this invention may be practiced other than as specifically described. Thus, the present embodiments of the invention should be considered in all respects as illustrative and not restrictive and the scope of the invention determined by the claims supported by this application and their equivalents.

What is claimed is:

1. A dual-patch antenna array, comprising:

a plurality of dual-patch antennas, each dual-patch antenna comprising:

a ground plane;

a first patch plate parallel to and separated from the ground plane by a separation distance;

a second patch plate separated from the ground plane by the separation distance, coplanar with the first patch plate, and separated from the first patch plate by a radiating slot;

an excitation probe isolatedly passing through the ground plane and connecting to the first patch plate;

a first wall connecting an edge of the first patch plate to the ground plane, the first wall located approximately ¼ wavelength of a mid-band operating frequency from the radiating slot; and a second wall connecting an edge of the second patch plate to the ground plane, the second wall located approximately ¼ wavelength of the mid-band operating frequency from the radiating slot, wherein the radiating slots are colinear.

2. The dual-patch antenna array of claim 1, wherein the separation distance is approximately 8 cm and an operating frequency of the antenna includes 150 MHz.

3. The dual-patch antenna array of claim 1, wherein the ground plane, the first patch plate, the second patch plate, the radiating slot, the first wall, and the second wall are each rectangular.

4. The dual-patch antenna array of claim 1, wherein each of the excitation probes connects to the corresponding first patch plate at a location near the midpoint of the corresponding radiating slot.

5. The dual-patch antenna' array of claim 1, where the dual-patch antennas are contiguous.

6. A dual-patch antenna array, comprising:

a plurality of dual-patch antenna sub arrays, each dual-patch antenna sub array comprising a plurality of dual-patch antennas, each dual-patch antenna comprising:

a ground plane;

a first patch plate parallel to and separated from the ground plane by a separation distance;

a second patch plate separated from the ground plane by the separation distance, coplanar with the first patch plate, and separated from the first patch plate by a radiating slot;

an excitation probe isolatedly passing through the ground plane and connecting to the first patch plate;

a first wall connecting an edge of the first patch plate to the ground plane, the first wall located approximately ¼ wavelength of a mid-band operating frequency from the radiating slot; and a second wall connecting an edge of the second patch plate to the ground plane, the second wall located approximately ¼ wavelength of the mid-band operating frequency from the radiating slot, wherein the radiating slots within each dual-patch antenna subarray are colinear within the dual-patch antenna array and are substantially parallel to the radiating slots of the other dual-patch antenna subarrays.

7. The dual:-patch antenna array of claim 6, wherein the separation distance is approximately 8 cm and an operating frequency of the antenna includes 150 MHz.

8. The dual-patch antenna array of claim 6, wherein the ground plane, the first patch plate, the second patch plate, the radiating slot, the first wall, and the second wall are each rectangular.

9. The dual-patch antenna array of claim 6, wherein each of the excitation probes connects to the corresponding first patch plate at a location near the midpoint of the corresponding radiating slot.

10. The dual-patch antenna array of claim 6, wherein the dual-patch antennas are contiguous within each sub array.

* * * * *